US008595875B2

(12) United States Patent
Im et al.

(10) Patent No.: US 8,595,875 B2
(45) Date of Patent: Dec. 3, 2013

(54) LAUNDRY TREATMENT MACHINE AND WASHING METHOD THEREFOR

(75) Inventors: Myong Hum Im, Seoul (KR); Byung Keol Choi, Seoul (KR); Woo Young Kim, Seoul (KR); Kyung Chul Woo, Seoul (KR); Kyeong Hwan Kim, Seoul (KR); Han Gil Park, Seoul (KR); Soo Young Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 893 days.

(21) Appl. No.: 12/510,552

(22) Filed: Jul. 28, 2009

(65) Prior Publication Data

US 2010/0064448 A1 Mar. 18, 2010

(30) Foreign Application Priority Data

Sep. 12, 2008 (KR) ..... 10-2008-0090211

(51) Int. Cl.
*D06F 33/00* (2006.01)

(52) U.S. Cl.
USPC ..... 8/159; 8/158; 68/12.01; 68/12.02; 68/12.05; 68/12.19; 68/12.21

(58) Field of Classification Search
USPC ..... 8/159, 158; 68/12.02, 12.01, 12.05, 68/12.19, 12.21
See application file for complete search history.

(56) References Cited

U.S. PATENT DOCUMENTS

| | | | | |
|---|---|---|---|---|
| 4,662,193 | A * | 5/1987 | Honda | 68/12.05 |
| 5,692,259 | A * | 12/1997 | Lee et al. | 8/158 |
| 5,758,377 | A * | 6/1998 | Cimetta et al. | 8/158 |
| 6,048,369 | A * | 4/2000 | Smith et al. | 8/475 |
| 7,376,998 | B2 * | 5/2008 | Seo et al. | 8/159 |
| 7,530,132 | B2 * | 5/2009 | Kim | 8/158 |
| 2006/0191300 | A1 | 8/2006 | Lim et al. | |
| 2007/0283507 | A1 * | 12/2007 | Wong et al. | 8/149.3 |

FOREIGN PATENT DOCUMENTS

| | | | |
|---|---|---|---|
| CN | 1319695 | | 10/2001 |
| DE | GB 2 168 388 | | 6/1986 |
| DE | 10 2007 043 400 | | 4/2008 |
| EP | 1 281 803 | | 11/2001 |
| EP | 1 867 773 | | 6/2007 |
| EP | 1867773 | A1 * | 12/2007 |
| JP | 08-141271 | | 6/1996 |
| JP | 08-141272 | | 6/1996 |
| JP | 02-282575 | | 10/2002 |
| JP | 07-202636 | | 8/2007 |

OTHER PUBLICATIONS

European Search Report dated Apr. 18, 2012.
European Search Report dated Sep. 23, 2009.

* cited by examiner

*Primary Examiner* — Michael Kornakov
*Assistant Examiner* — Marc Lorenzi
(74) *Attorney, Agent, or Firm* — KED & Associates LLP

(57) ABSTRACT

A laundry treatment machine and a washing method therefor are provided. The laundry treatment machine may discharge fluid by driving a drainage device, while rotating a drum during a time period between a plurality of rinsing operations. The rotation speed of the drum may be controlled to be lower than a reference speed, which is the rotation speed of the drum when laundry is not uniformly distributed in the drum, and thus, eccentricity of the laundry is high.

5 Claims, 5 Drawing Sheets

LAUNDRY TREATMENT MACHINE AND WASHING METHOD THEREFOR

CROSS-REFERENCE TO RELATED APPLICATION

This application claims priority to Korean Patent Application No. 10-2008-0090211, filed in Korea on Sep. 12, 2008, the disclosure of which is incorporated herein by reference in its entirety.

BACKGROUND

1. Field

A laundry treatment machine and a washing method for a laundry treatment machine are disclosed herein.

2. Background

Laundry treatment machines may treat laundry with a fluid, such as water, supplied into a drum by an external source, and discharge the used wash fluid to remove detergent residues from the laundry. Such detergent residues may be removed from the laundry and may be discharged along with the used wash fluid by a drainage device coupled to the drum.

BRIEF DESCRIPTION OF THE DRAWINGS

Embodiments will be described in detail with reference to the following drawings in which like reference numerals refer to like elements, and wherein.

DETAILED DESCRIPTION

Figure 1:
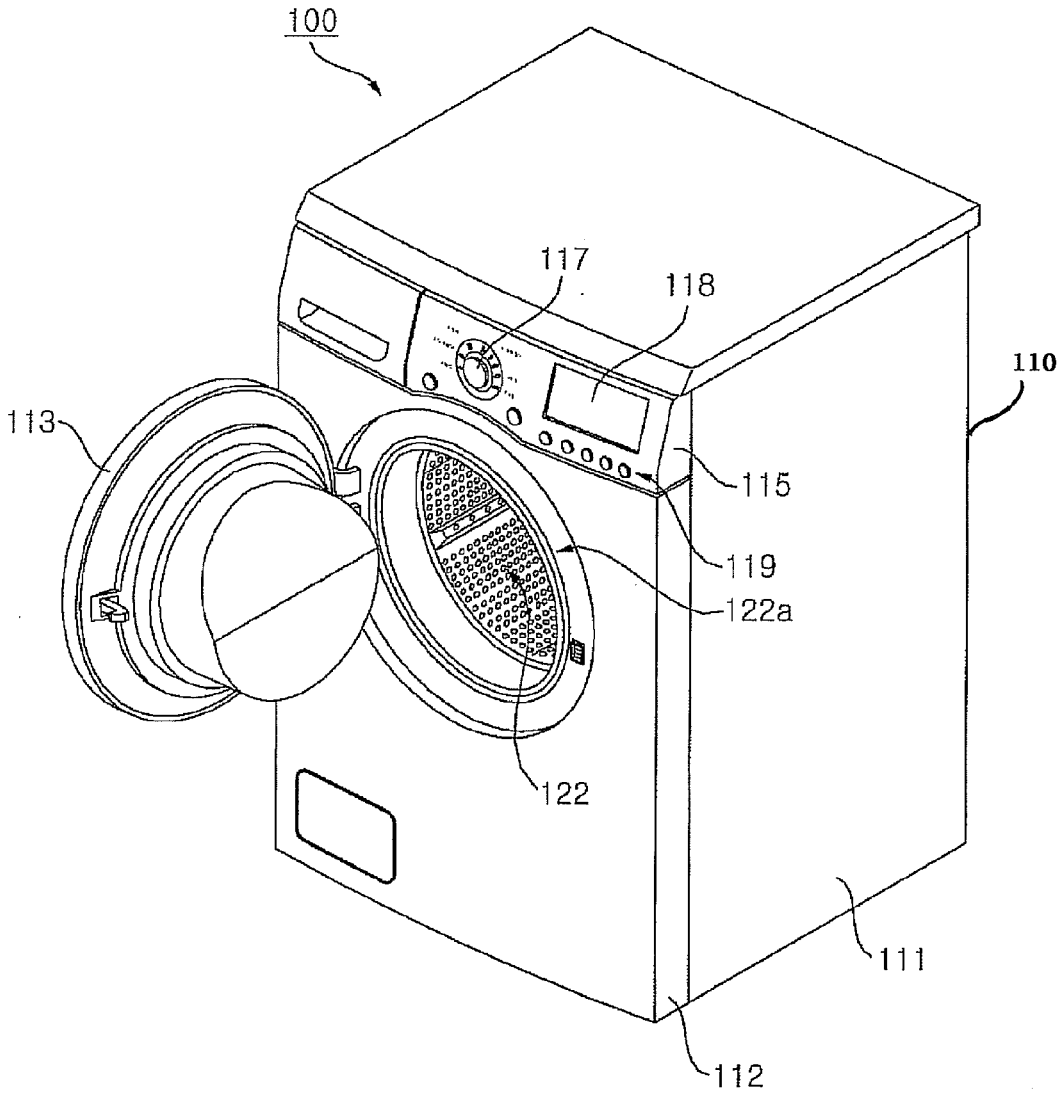
FIG. 1 is a front perspective view of a laundry treatment machine according to an embodiment.

Embodiments will hereinafter be described in detail with reference to the accompanying drawings, in which like reference numerals have been used to indicate like elements.

FIG. 1 is a front perspective view of a laundry treatment machine according to an embodiment.

Figure 2:
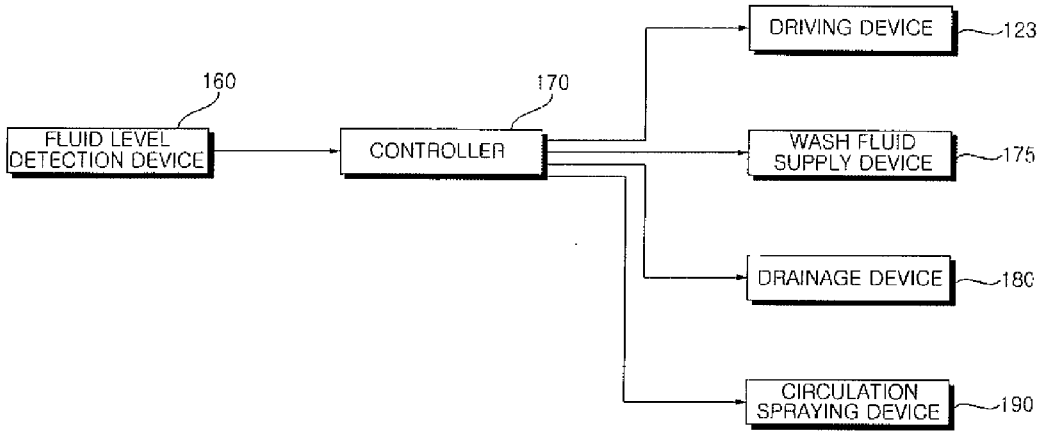
FIG. 2 is a block diagram of the laundry treatment machine of FIG. 1.

FIG. 2 is a block diagram of the laundry treatment machine of FIG. 1. Referring to FIGS. 1 and 2, the laundry treatment machine 100 may include a cabinet 110; a drum 122 rotatably disposed in the cabinet 110 and configured to receive therein laundry to be washed; a tub (not shown) disposed around the drum 122 and configured to contain a fluid, such as water; a wash fluid supply device 175 configured to supply wash fluid to the tub and drum 122; a drainage device 180 connected to the tub and configured to discharge fluid from the drum 122; and a controller 170 that drives the drainage device 180 while controlling the drum 122 to rotate during a time period between a plurality of rinsing operations. The cabinet 110 may include a main body 111 in which the drum 122 is disposed, a top plate 119 which is coupled to the main body 111, and a cover 112 which is coupled to a front of the main body 111. The cover 112 may include an inlet/outlet hole 122*a* through which laundry may be inserted into or removed from the laundry treatment machine 100 and a door 113 rotatably coupled to the cover 112 and configured to open or close the inlet/outlet hole 122*a*.

When a washing operation is completed, the laundry treatment machine 100 may perform a rinsing operation to separate detergent residues from laundry using a fluid, such as water, not mixed with detergent. When the rinsing operation begins, the fluid not mixed with detergent may be supplied into the drum 122. Laundry in the drum 122 may absorb the fluid supplied into the drum 122. The fluid absorbed into the laundry may be separated from the laundry due to rotation of the drum 122. Thereafter, the fluid separated from the laundry may be discharged from the drum 122 due to the rotation of the drum 122. The discharged fluid may be contained in the tub (not shown). Thereafter, the fluid contained in the tub may be discharged from the laundry treatment machine 100 by the drainage device 180. The controller 170 may drive the drainage device 180 while controlling the drum 122 to rotate during a time period between a plurality of rinsing operations.

More specifically, when a washing operation is completed and a rinsing operation begins, the fluid not mixed with detergent may be supplied into the drum 122. The fluid may be absorbed into the laundry, and may remove detergent residues contained in the laundry. When the fluid is supplied into the drum 122, the drum 122 may begin to rotate. Due to the rotation of the drum 122, the laundry may be lifted up and dropped down, thereby forming potential energy. Due to the potential energy, detergent residues may be removed from the laundry. In addition, the rotation of the drum 122 may cause friction between the fluid and the laundry. Due to the friction between the fluid and the laundry, detergent residues may be removed from the laundry. Once detergent residues are all removed from the laundry, the fluid containing the detergent residues may be discharged. For this, the drainage device 180 may be driven. When the drainage device 180 is driven, fluid contained in the tub may be discharged. During the operation of the drainage device 180, the drum may be controlled to continuously rotate. As a result, the laundry may be preliminarily dehydrated, and fluid removed from the laundry by the preliminary dehydration may be discharged into the tub. The fluid discharged into the tub may be discharged to outside of the laundry treatment machine 100 along with the fluid previously contained in the tub. Therefore, it may be possible to reduce the time taken to drain the tub. In addition, since the drum 122 is kept rotating during the drainage of fluid from the tub, and thus, the laundry is preliminarily dehydrated, it may be possible to reduce the time taken to dehydrate the laundry during a dehydration operation that follows a rinsing operation.

A fluid level detection device 160 may measure a fluid level in the tub during the drainage of a fluid by the drainage device 180. The controller 170 may decide whether to rotate the drum 122 during the drainage of fluid from the tub based on the measured fluid level. More specifically, if the measured fluid level is higher than a first reference fluid level, the controller 170 may stop the drum 122 from rotating, and may drive the drainage device 180. On the other hand, if the measured fluid level is lower than the first reference fluid level, the controller 170 may drive the drainage device 180 while controlling the drum 122 to rotate. Therefore, it may be possible to prevent the rotation of the drum 122 from being interfered with by the fluid, and thus, to reduce the load of a driving device 123.

The controller 170 may control the driving device 123 to rotate the drum 122 at a speed lower than a reference speed, which is the rotation speed of the drum 122 when laundry is not uniformly distributed in the drum, and thus, eccentricity of the laundry is high. If the drum 122 rotates at a speed higher than the reference speed, the eccentricity of the laundry may increase. In this case, the drum 122 may vibrate severely, and thus, may generate noise and cause damage to the laundry and the laundry treatment machine 100. Therefore, the controller 170 may prevent noise and damage to the laundry and the laundry treatment machine 100 by maintaining the rotation speed of the drum 122 below the reference speed.

The controller 170 may perform a rinsing operation repeatedly. Thereafter, the controller 170 may control the drum 122 to rotate at a fixed speed, and thus, may uniformly distribute laundry in the drum 122. If the laundry is uniformly distributed in the drum 122, the controller 170 may also control the drum 122 to rotate, and thus, may dehydrate the laundry. That is, if one or more rinsing operations are completed, the controller 170 may uniformly distribute laundry in the drum 122 by rotating the drum 122 at a fixed speed.

The laundry treatment machine 100 may also include a circulation spraying device 190, which circulates fluid and thus sprays the circulated fluid into the drum 122. The controller 170 may perform a rinsing operation repeatedly. Thereafter, the fluid level detection device 160 may measure the fluid level in the tub, and the controller 170 may control the circulation spraying device 190 based on the measured fluid level provided by the fluid level detection device 160. More specifically, the controller 170 may determine whether the measured fluid level is higher than a second reference fluid level. Thereafter, if the measured fluid level is higher than the second reference fluid level, the controller 170 may control the circulation spraying device 190 to spray fluid into the drum 122 while controlling the drum 122 to rotate. On the other hand, if the measured fluid level is lower than the second reference fluid level, the controller 170 may control the circulation spraying device 190 to spray wash fluid into the drum 122 without rotating the drum 122. In short, the controller 170 may control the circulation spraying device 190 in consideration of the measured fluid level while preventing the eccentricity of the laundry in the drum 122 from increasing.

Figure 3A:
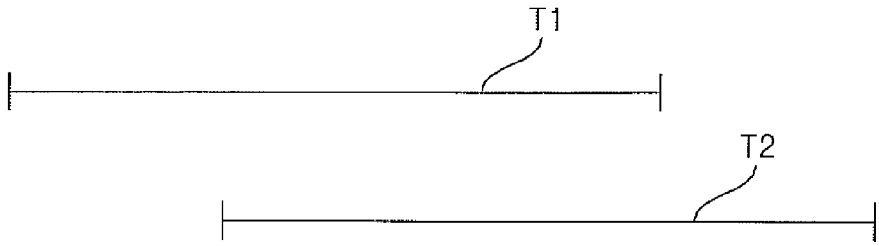
FIGS. 3A-3C are diagrams illustrating a relationship between a time period during which a drum of the laundry treatment machine of FIGS. 1-2 rotates and a time period during which a drainage device of the laundry treatment machine of FIGS. 1-2 is driven.
Figure 3B:
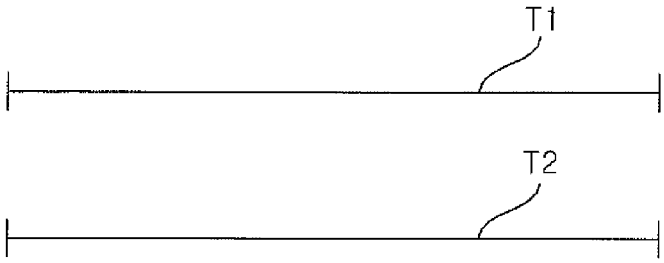
Figure 3C:
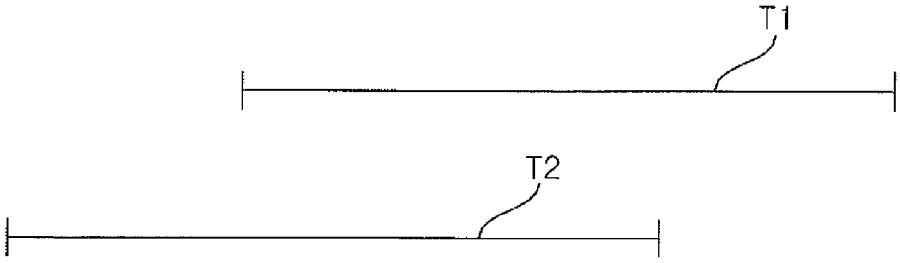

FIGS. 3A-3C are diagrams illustrating a relationship between a time period T1 during which the drum 122 rotates and a time period T2 during which the drainage device 180 is driven. Referring to FIG. 3, the controller 170 may control the drum 122 to rotate during the time period T1, and may discharge fluid by driving the drainage device 180 during the time period T2. The controller 170 may control the time period T1 and the time period T2 to overlap at least partially with each other.

More specifically, referring to FIG. 3A, the drainage device 180 may not necessarily be driven during the rotation of the drum 122. A predetermined amount of time after the beginning of the rotation of the drum 122, the drainage device 180 may begin to be driven, and thus, may discharge fluid from the drum 122.

Alternatively, referring to FIG. 3B, the controller 170 may control the time period T1 and the time period T2 to coincide with each other. That is, the controller 170 may control the drum 122 to rotate during the time period T1, and may discharge fluid by driving the drainage device 180 during the time period T2.

Still alternatively, referring to FIG. 3C, the controller 170 may discharge fluid from the drum 122 by driving the drainage device 180. A predetermined amount of time after the beginning of the driving of the drainage device 180, the controller 170 may control the drum 122 to rotate during the time period T1.

In this manner, it may be possible to reduce the time taken to perform a rinsing operation by controlling the time period T1 and the time period T2 to overlap at least partially with each other.

Figure 4:
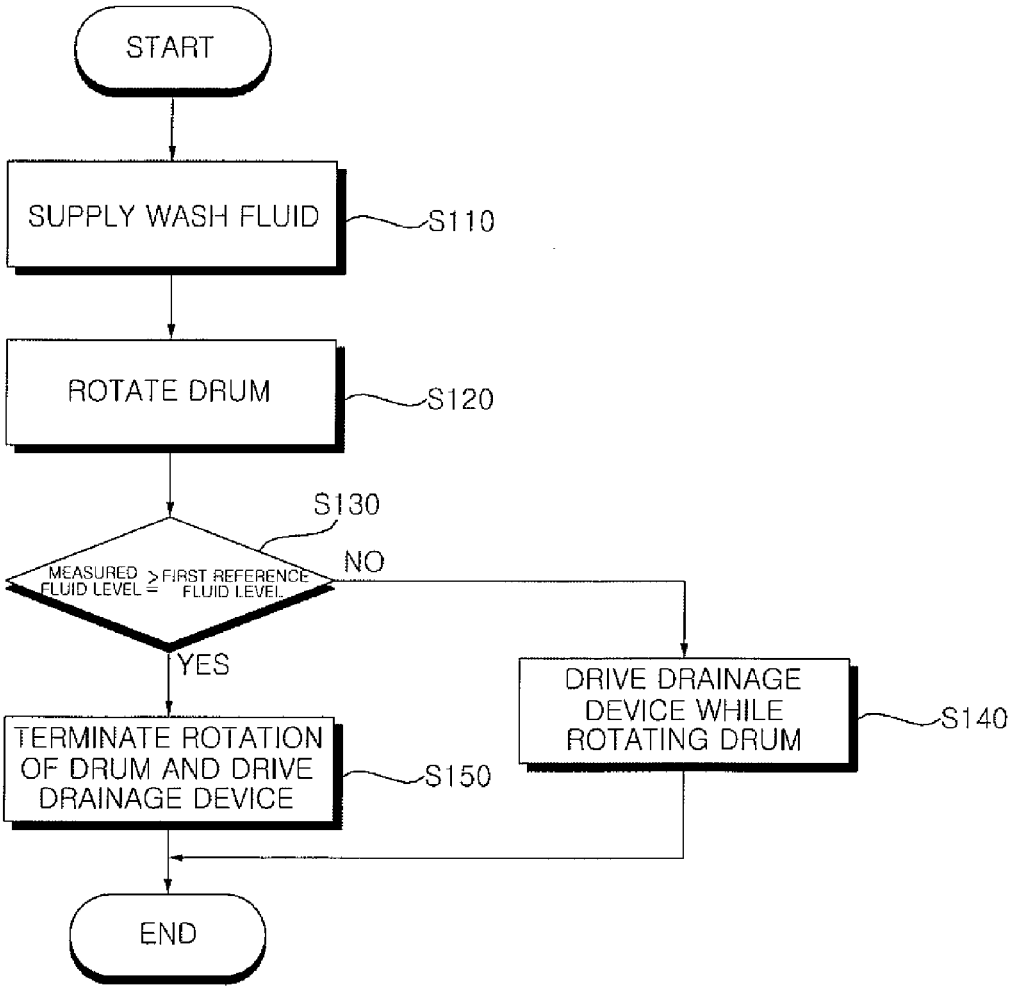
FIG. 4 is a flowchart of a washing method for a laundry treatment machine according to an embodiment.

FIG. 4 is a flowchart of a washing method for a laundry treatment machine according to an embodiment. Referring to FIG. 4, when a washing operation is completed, fluid not mixed with detergent may be supplied to a drum 122, in step S110. Thereafter, the controller 170 may control the drum 122 to rotate, in step S120. As a result of step S120, detergent residues contained in laundry in the drum 122 may be isolated due to the rotation of the drum 122 and the drop of the laundry. Thereafter, the used fluid may be discharged. Thereafter, the fluid level detection device 160 may measure the fluid level in the tub. Thereafter, the controller 170 may compare the measured fluid level with a first reference fluid level, in step S130. If the measured fluid level is higher than the first reference fluid level, the controller 170 may stop the drum 122 from rotating and may then drive the drainage device 180, in step S150. On the other hand, if the measured fluid level is lower than the first reference level, the controller 180 may discharge fluid by driving the drainage device 180 while rotating the drum 122, in step S140. In this manner, it may be possible to effectively perform a preliminary dehydration operation on laundry in the drum 122 by rotating the drum 122 when a rinsing operation is complete. In addition, it may be possible to reduce the time taken to perform a dehydration operation by preliminarily dehydrating the laundry in the drum 122.

In step S140, the controller 170 may control the drum 122 to rotate at a speed lower than a reference speed, which is the rotation speed of the drum 122 when laundry is not uniformly distributed in the drum 122, and thus, eccentricity of the laundry is high. However, the rotation speed of the drum 122 is not restricted to this embodiment. That is, the rotation speed of the drum 122 may be experimentally optimized in various manners.

Figure 5:
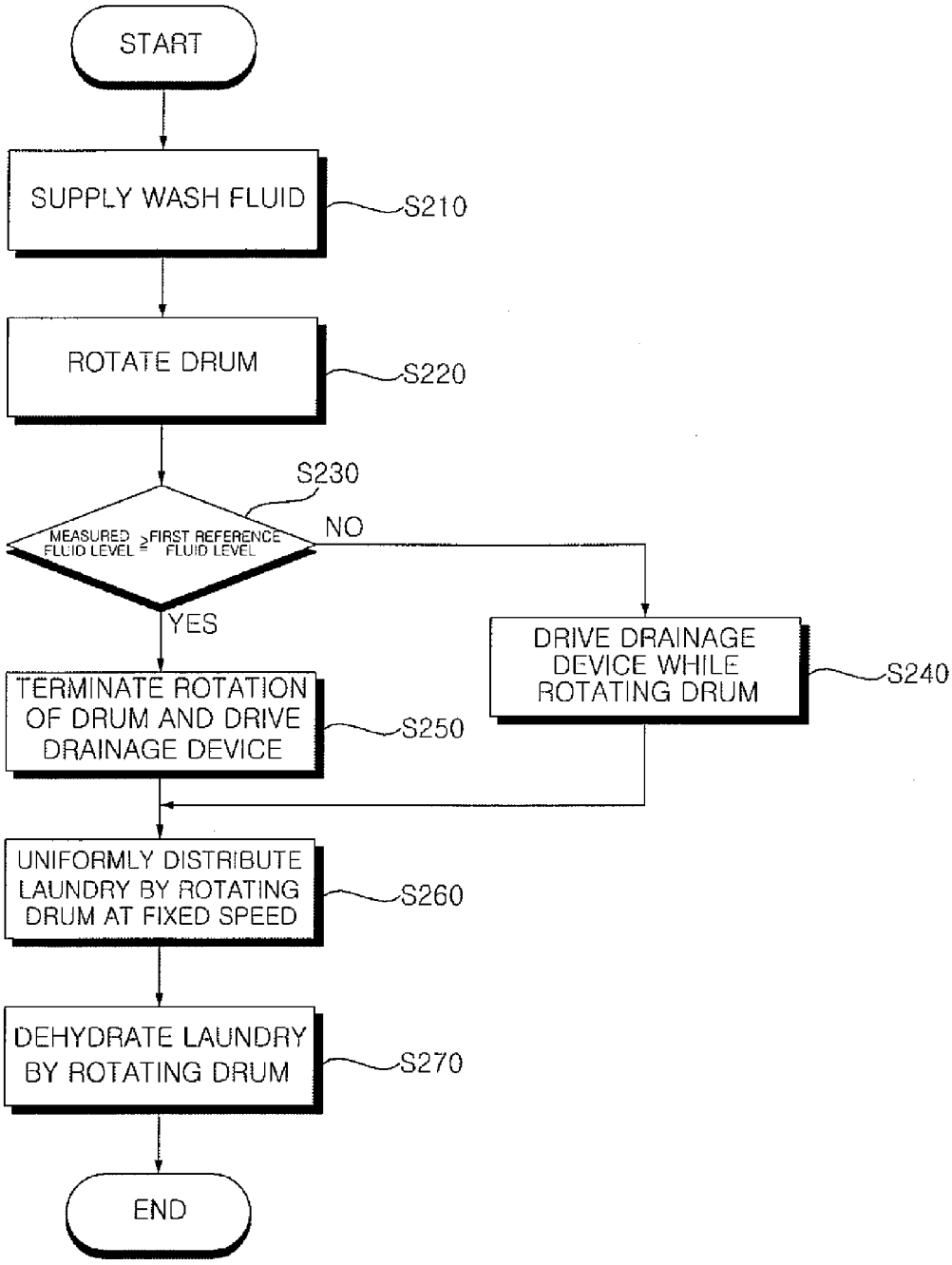
FIG. 5 is a flowchart of a washing method for a laundry treatment machine according to another embodiment.

FIG. 5 is a flowchart of a washing method for a laundry treatment machine according to another embodiment. Referring to FIG. 5, a rinsing operation may be performed, in step S210 through S250 in the same manner as or a similar manner to that described above with reference to FIG. 4. Thereafter, when the rinsing operation is completed, the controller 170 may uniformly distribute the laundry in the drum 122 by rotating the drum 122 at a fixed speed, in step S260. Thereafter, the controller 170 may dehydrate the laundry in the drum 122 by rotating the drum 122, in step S270. Thus, the laundry treatment machine 100 may preliminarily dehydrate the laundry in the drum 122 during a rinsing operation. Then, when the rinsing operation is completed, the laundry treatment machine 100 may perform a dehydration operation. Therefore, it may be possible to reduce the time taken to perform a dehydration operation by preliminarily dehydrating the laundry in the drum 122 during a rinsing operation.

Embodiments disclosed herein provide a laundry treatment machine that may reduce a time taken to discharge used fluid during a rinsing operation and a washing method of the laundry treatment machine.

Embodiments disclosed herein provide a laundry treatment machine that may include a drum which is installed so as to be able to rotate and in which laundry is washed; a tub which is disposed outside the drum and contains wash water or fluid; a drainage device which is connected to the tub and discharges wash fluid from the drum; and a control unit or controller which drives the drainage device while controlling the drum to rotate during a time period between a plurality of rinsing operations for rinsing the laundry.

Embodiments disclosed herein provide a washing method that may include supplying wash fluid not mixed with a detergent into a tub; rotating a drum; and discharging the wash fluid by driving a drainage device while rotating the drum.

According to embodiments, during a time period between a plurality of rinsing operations, wash fluid may be discharged by driving a drainage device while rotating the drum.

Therefore, it may be possible to preliminarily dehydrate laundry in the drum. Fluid removed from the laundry by the dehydration may be discharged along with used wash fluid by the drainage device. Therefore, it may be possible to reduce the time taken to perform a drainage operation, and thus, to reduce the time taken to perform a dehydration operation.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing method for a laundry treatment machine, comprising:

supplying fluid into a tub having a rotatable drum rotatably received therein;

operating a driving device and rotating the drum after stopping the supplying of the fluid into the tub;

measuring a first fluid level in the tub;

discharging the fluid from the tub by operating a drainage device during a rinsing operation, wherein the drainage device is operated while rotating the drum if the first measured fluid level in the tub is lower than a first reference fluid level, and wherein the drainage device is operated without rotating the drum by stopping the driving device if the first measured fluid level in the tub is higher than the first reference fluid level; and after stopping the drainage device, measuring a second fluid level in the tub;

circulating the fluid in the tub and spraying the circulating fluid into the drum via a circulation spraying device, wherein the spraying device is operated while rotating the drum if the second measured fluid level in the tub is higher than a second reference fluid level, and wherein the spraying device is operated without rotating the drum if the second measured fluid level in the tub is lower than the second reference fluid level.

2. The washing method of claim 1, wherein the rinsing operation is performed prior to a spinning operation that dehydrates laundry received in the drum.

3. The washing method of claim 1, wherein while the drainage device discharges the fluid, the driving device rotates the drum at a speed lower than a reference speed, which is a rotational speed of the drum when laundry received in the drum is not uniformly distributed in the drum.

4. The washing method of claim 1, further comprising distributing laundry received in the drum by rotating the drum at a fixed speed.

5. The washing method of claim 4, wherein, if the laundry is distributed in the drum, the method further comprises dehydrating the laundry by rotating the drum.

* * * * *